US005863011A

United States Patent [19]

Narita et al.

[11] Patent Number: 5,863,011

[45] Date of Patent: Jan. 26, 1999

[54] CORE SECURING DEVICE IN WEB WINDING APPARATUS

[75] Inventors: Keizo Narita, Kyoto; Hirokazu Kano, Uji; Tomoyuki Nomura, Jyoyo; Yasunari Kamikubo, Kusatsu, all of Japan

[73] Assignee: Nishimura Seisakusho Co., Ltd., Kyoto, Japan

[21] Appl. No.: 742,089

[22] Filed: Oct. 29, 1996

[30] Foreign Application Priority Data

Oct. 31, 1995 [JP] Japan ..... 7-308452

[51] Int. Cl.[6] ..... B65H 75/24

[52] U.S. Cl. ..... 242/573; 242/573.4

[58] Field of Search ..... 242/573, 573.4, 242/573.7, 573.9

[56] References Cited

U.S. PATENT DOCUMENTS

| | | | |
|---|---|---|---|
| 2,298,759 | 10/1942 | Fouse | 242/573.4 |
| 3,263,937 | 8/1966 | Kirilouckas | 242/573.7 X |
| 3,420,465 | 1/1969 | Brunner et al. | 242/573.9 |
| 3,489,363 | 1/1970 | Diolot | 242/573.9 |
| 3,990,690 | 11/1976 | Lick | 242/573 X |
| 3,998,400 | 12/1976 | Gee et al. | 242/573.7 X |
| 4,079,896 | 3/1978 | Plach | 242/573 |
| 4,148,444 | 4/1979 | Hehner | 242/573 X |
| 4,149,682 | 4/1979 | Gustafson et al. | 242/573 X |
| 5,170,960 | 12/1992 | Pretto | 242/573 |

FOREIGN PATENT DOCUMENTS

| | | |
|---|---|---|
| 1601502A | 10/1970 | France . |
| 2723964A | 12/1978 | Germany . |
| 60-122650 | 7/1985 | Japan . |
| 02052837 | 2/1990 | Japan . |
| 03106744 | 5/1991 | Japan . |
| 06316355 | 11/1994 | Japan . |

*Primary Examiner*—Donald P. Walsh
*Assistant Examiner*—William A. Rivera
*Attorney, Agent, or Firm*—Morgan & Finnegan, LLP

[57] ABSTRACT

An apparatus for winding a web material such as paper or plastic film about a hollow core. The core is disposed between a pair of shafts spaced from and axially opposed and aligned with each other. The core is fixed at opposite ends to the shafts respectively. At least one of the shafts is connected to and rotated by a motor. Each of the shafts is comprised of an annular slide disposed around and coaxially to the shaft for axial movement relative to the shaft, and tapered surfaces formed on the circumferential outer surface of the slide. A plurality of tins are angularly spaced from each other along the circumference of the slide and engaged with the tapered surfaces. The tips are radially movable relative to the shaft. Each of the shafts includes a piston inserted into a bore in a cylinder, the piston being opposed to and engaged with the slide axially of the shaft, whereby the tips can be pressed against the inner surface of the core by the fluid pressure in the cylinder and under the effect of the tapered surfaces, to thereby fix the core to the shaft. Furthermore, at least one of the shafts is restrained from movement relative to the shaft in the rotational direction of the shaft to transmit a torque to the slide from the shaft, the tips on that slide also being restrained from movement relative to the slide in the rotational direction of the shaft to transmit torque to the tips from the slide.

15 Claims, 4 Drawing Sheets

CORE SECURING DEVICE IN WEB WINDING APPARATUS

FIELD OF THE INVENTION

The invention relates to an apparatus for winding a web material such as paper or plastic film about a hollow core. The core is disposed between a pair of shafts spaced from and opposed and aligned with each other axially thereof. The core is then fixed at opposite ends to the shafts respectively. At least one of the shafts is connected to and rotated by motor means.

PRIOR ART

There has been generally used an apparatus for slitting a web material such as paper or plastic film into a plurality of web materials and then winding the web materials about hollow cores. In the typical apparatus, each core is disposed between a pair of shafts which are spaced from and opposed and aligned with each other axially thereof. The core is then fixed at opposite ends to the shafts respectively. In what is called the taper cone type, each shaft is provided with a taper cone. The taper cones are moved axially of the shafts and inserted and fitted into the opposite ends of the core so that the core is fixed at opposite ends to the shafts by the taper cones. At least one of the shafts is connected to and rotated by motor means so that the core is rotated integrally with the taper cones and the shafts to wind the web material.

However, the apparatus has a problem that the core is not always accurately centered with respect to the shafts when the taper cones are inserted and fitted into the opposite ends of the core and the core is fixed at opposite ends to the shafts by the taper cones. Accordingly, the core may be rotated with a deflection. The web is wound with tension fluctuated by the deflection in the rotation, resulting in low quality of product.

SUMMARY OF THE INVENTION

It is therefore an object of the invention to provide a novel and improved apparatus for winding a web material such as paper or plastic film about a hollow core, the core being disposed between a pair of shafts spaced from and opposed and aligned with each other axially thereof, the core being fixed at opposite ends to the shafts respectively, at least one of the shafts being connected to and rotated by motor means, in which the above problem can be overcome.

It is another object of the invention to accurately center the core with respect to the shafts when the core is fixed at opposite ends to the shafts so that the core is rotated without deflection and the web is wound with a tension not fluctuated.

According to the invention, each of the shafts comprises an annular slide disposed around and coaxially to the shaft for movement axially thereof, tapered surface means being formed on the circumferential outer surface of the slide. A plurality of tips are angularly spaced from each other along the circumference of the slide and engaged with the tapered surface means. Means is provided for guiding the tips for movement radially of the shaft. Each of the shafts each includes piston means inserted into bore means in cylinder means, the piston means being opposed to and engaged with the slide axially of the shaft, whereby the tips can be pressed against the inner surface of the core by the fluid pressure in the cylinder means and under the effect of the tapered surface means, to thereby fix the core to the shaft. At least one of the shafts further comprises means for restraining the slide from moving relatively to the shaft in the rotational direction thereof to transmit a torque to the slide from the shaft, and means for restraining the tips from moving relatively to the slide in the rotational direction of the shaft to transmit the torque to the tips from the slide.

In a preferred embodiment, each of the shafts includes an end cap fitted onto and fixed to the end of the shaft. The slide is fitted onto the circumferential outer surface of the end cap for sliding movement axially of the shaft.

The means for guiding the tips comprises a flange formed integrally with the end cap and extending radially of the shaft. The tips are engaged with the flange for sliding movement.

The means for restraining the slide comprises a plurality of pins mounted on the flange and extending axially of the shaft. The pins are inserted into holes formed in the slide to transmit a torque to the slide from the shaft through the end cap and the flange.

The means for restraining the tips comprises a plurality of axial grooves formed in the circumferential outer surface of the slide. The tips are received in the axial grooves to transmit the torque to the tips from the slide. The tapered surface means comprises a plurality of tapered surfaces formed on the bottoms of the axial grooves. The tips are engaged with the tapered surfaces.

The cylinder means comprises an annular cylinder fitted onto the circumferential outer surface of the shaft. The piston means comprises an annular piston disposed around the shaft and inserted into an annular bore formed in the cylinder.

Each of the tips includes an urethane rubber layer formed on the outer surface thereof and pressed against the inner surface of the core.

Each of the shafts includes a ring spring disposed around the tips and the slide. The ring spring is fitted into circumferential grooves formed in the tips and the slide so that the tips are resiliently urged radially and axially of the shaft and brought into contact with the tapered surfaces and the flange by the ring spring. A plurality of springs are interposed between the slide and the flange so that the slide is resiliently urged axially of the shaft and brought into contact with the piston by the springs.

In another embodiment, each of the shafts comprises an annular piston disposed around and coaxially to the shaft. The piston is inserted into an annular bore formed in a cylinder for movement axially of the shaft. The shafts each includes tapered surface means formed on the circumferential outer surface of the piston. A plurality of tips are angularly spaced from each other along the circumference of the piston and engaged with the tapered surface means. Means is provided for guiding the tips for movement radially of the shaft, whereby the tips can be pressed against the inner surface of the core by the fluid pressure in the cylinder and under the effect of the tapered surface means, to thereby fix the core to the shaft. At least one of the shafts further comprises means for restraining the piston from moving relatively to the shaft in the rotational direction thereof to transmit a torque to the piston from the shaft, and means for restraining the tips from moving relatively to the piston in the rotational direction of the shaft to transmit the torque to the tips from the piston.

The cylinder may be annular and fitted onto the circumferential outer surface of the shaft.

The means for guiding the tips may comprise an end plate engaged with and fixed to the end of the shaft. The end plate extends radially of the shaft. The tips are engaged with the end plate for sliding movement.

The means for restraining the piston may comprise key means fitted into axial grooves formed in the cylinder and the shaft to transmit a torque to the cylinder from the shaft, and key means fitted into axial grooves formed in the piston and the cylinder to transmit the torque to the piston from the cylinder.

The tapered surface means may comprise a tapered surface extending circumferentially of the piston. The means for restraining the tips may comprise key means fitted into axial grooves formed in the tips and the piston to transmit the torque to the tips from the piston.

The tips may each include an urethane rubber layer formed on the outer surface thereof and pressed against the inner surface of the core.

The shafts may each include a ring spring disposed around the tips. The ring spring is fitted into circumferential grooves formed in the tips so that the tips are resiliently urged radially and axially of the shaft and brought into contact with the tapered surface and the end plate by the ring spring. A plurality of springs may be interposed between the piston and the end plate so that the piston is resiliently urged axially of the shaft by the springs.

DESCRIPTION OF PREFERRED EMBODIMENTS

Figure 1:
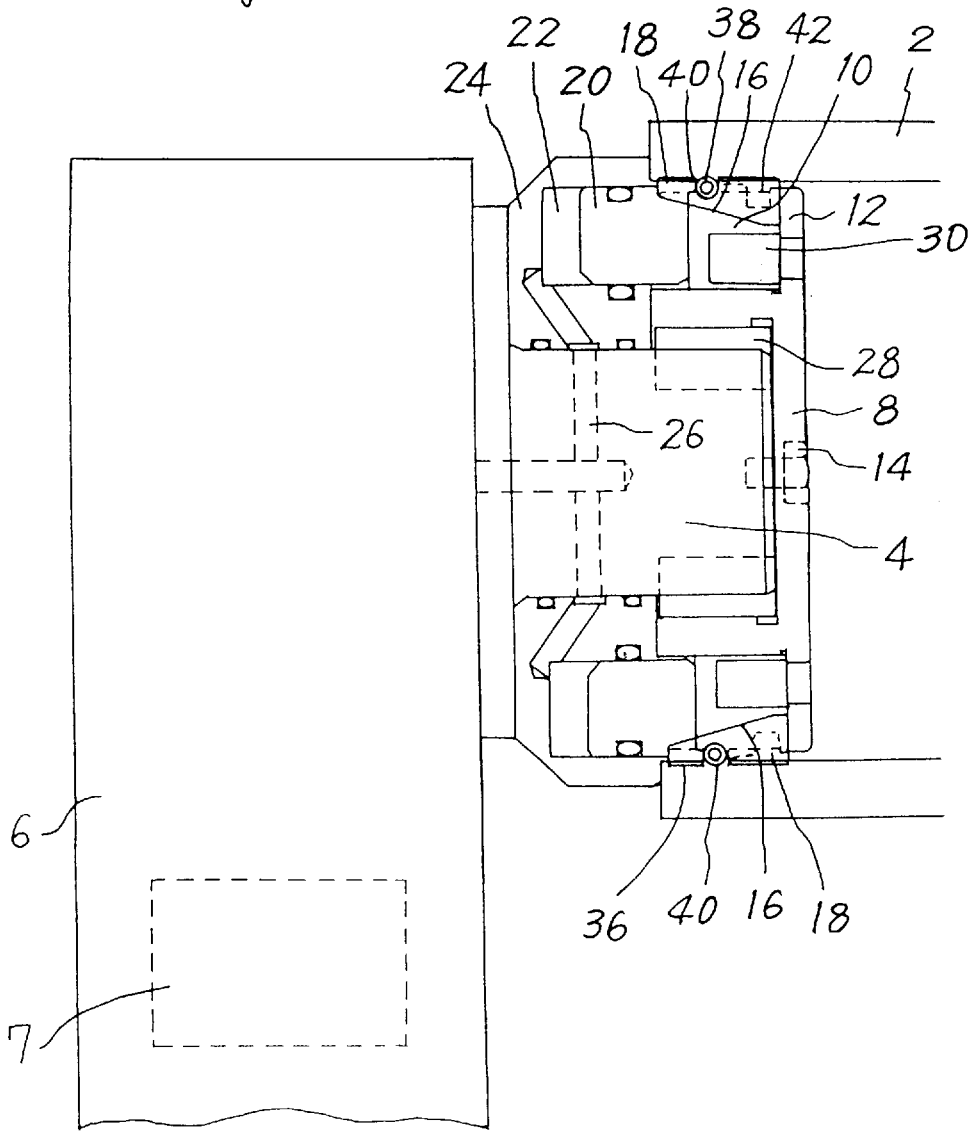
FIG. 1 is a longitudinal sectional view of a preferred embodiment of the invention.

Referring to FIG. 1, an apparatus according to the invention is shown, which is intended to wind a web material such as paper or plastic film about a hollow core 2. The core 2 is disposed between a pair of shafts 4. The shafts 4 are supported by a pair of arms 6 for rotation respectively to extend from the arms 6 so that each of the shafts 4 are spaced from and opposed and aligned with each other axially thereof. However, one of each of the shafts 4 is only shown with one of the arms 6 in FIG. 1 for convenience.

The apparatus includes a pair of cylinders not shown and connected to the arms 6. The arms 6 can be moved axially of the shafts 4 by the cylinders to insert the shafts 4 into the opposite ends of the core 2, as shown in FIG. 1. The core 2 is then fixed at opposite ends to the shafts 4 respectively, as described later on. In addition, at least one of the shafts 4 is connected to and rotated by motor means 7 disposed in and supported by the arm 6 so that the core 2 is rotated integrally with the shafts 4 to wind the web material.

Each of the shafts 4 includes an end cap 8 which has an inner diameter corresponding to the outer diameter of the shaft 4. The end cap 8 is fitted onto the end of the shaft 4. In addition, each of the shafts 4 includes an annular slide 10 which has an inner diameter corresponding to the outer diameter of the end cap 8. The slide 10 is disposed around and coaxially to the shaft 4 and fitted onto the circumferential outer surface of the end cap 8 for sliding movement axially of the shaft 4. The end cap 8 includes a flange 12 formed integrally therewith and extending radially of the shaft 4 to stop the slide 10 moved along the circumferential outer surface of the end cap 8. The end cap 8 is fixed to the end of the shaft 4 by bolts 14.

Figure 2:
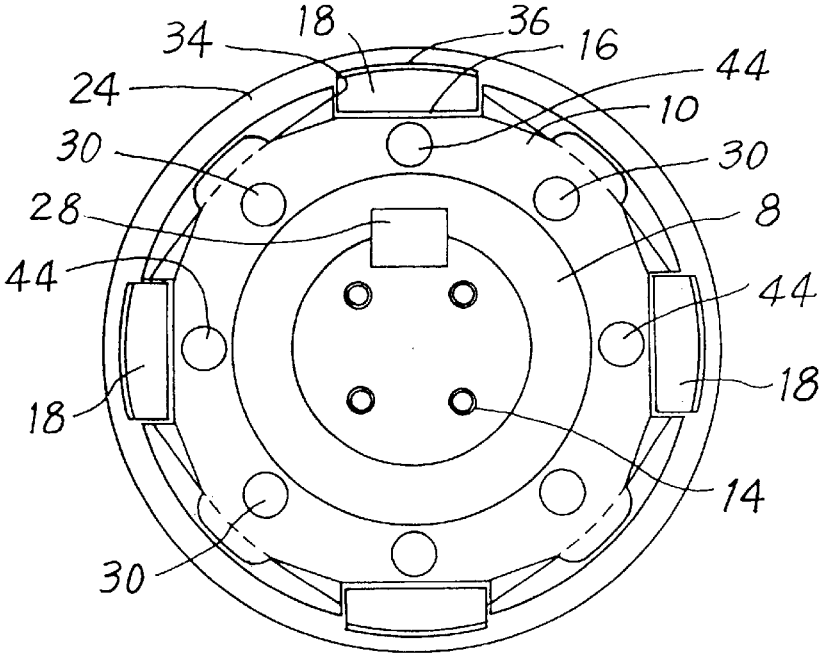
FIG. 2 is a cross sectional view of the apparatus in FIG. 1.
Figure 3:
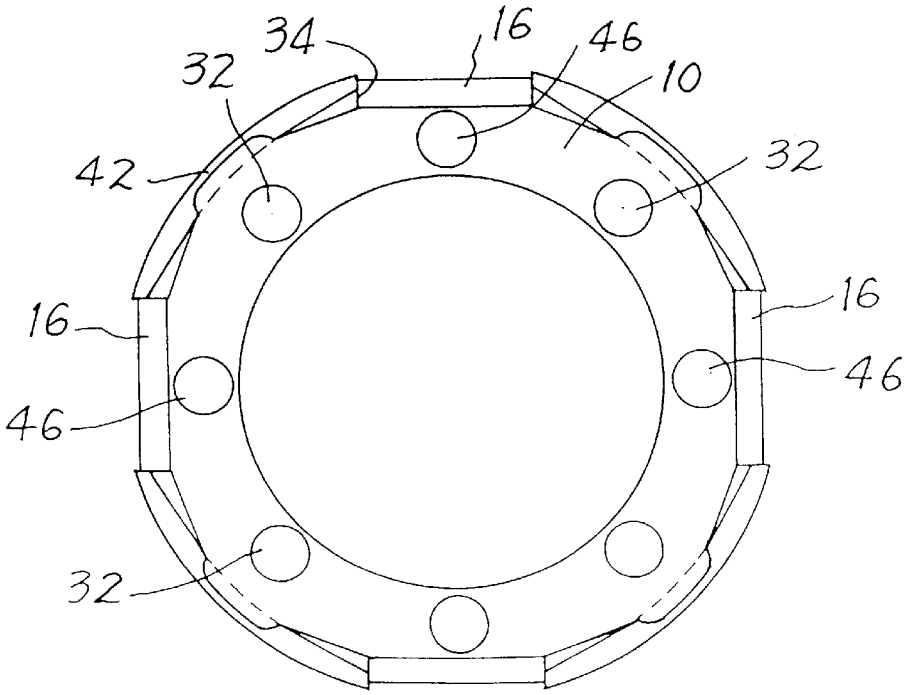
FIG. 3 is an elevational view of the slide in FIG. 2.
Figure 4:
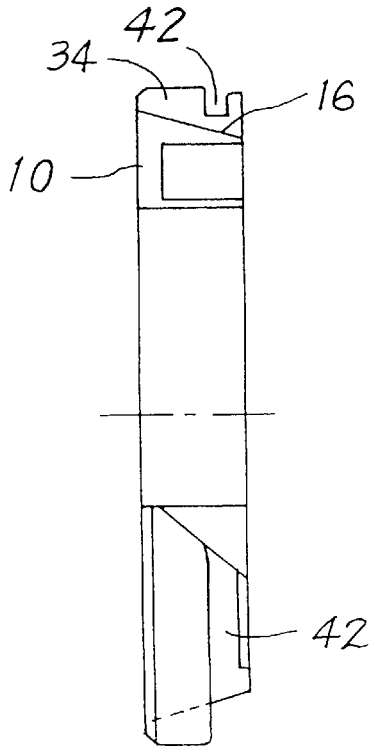
FIG. 4 is a longitudinal sectional view of the slide in FIG. 3.

The slide 10 includes tapered surface means 16 comprising a plurality of tapered surfaces which are formed on the circumferential outer surface of the slide 10. A plurality of tips 18 are angularly spaced from each other along the circumference of the slide 10 and engaged with the tapered surfaces 16. In the embodiment, four tapered surfaces 16 are equiangularly spaced from each other along the circumference of the slide 10, four tips 18 being equiangularly spaced from each other and engaged with the tapered surfaces 16 respectively, as shown in FIGS. 2 and 3. The tapered surfaces 16 are inclined radially and axially of the shaft 4, as shown in FIG. 4. The flange 12 is adapted to guide the tips 18 for movement radially of the shaft 4. The tips 18 are engaged with the flange 12 for sliding movement.

Each of the shafts 4 includes piston means 20 inserted into bore means 22 in cylinder means 24. The cylinder means 24 comprises an annular cylinder disposed around and coaxially to the shaft 4 and fitted onto the circumferential outer surface thereof. The end cap 8 is engaged with and pressed against the cylinder 24 axially of the shaft 4 to thereby fix the cylinder 24 to the shaft 4. The piston means 20 comprises an annular piston disposed around and coaxially to the shaft 4 and inserted into an annular bore 22 formed in the cylinder 24. The piston 20 is opposed to and engaged with the slide 10 axially of the shaft 4. The bore 22 is connected to a fluid supply by means of flow paths 26 formed in the shaft 4 and the cylinder 24.

In the apparatus, the arms 6 are moved axially of the shafts 4 to insert the shafts 4 into the opposite ends of the core 2 which is disposed between the shafts 4. In each shaft 4, a fluid pressure is then fed into the bore 22 in the cylinder 24 through the flow paths 26 so that the piston 20 is pushed against the slide 10 and moved and advanced in the bore 22 axially of the shaft 4. The slide 10 is therefore slidingly moved along the circumferential outer surface of the end cap 8 axially of the shaft 4 by the fluid pressure in the cylinder 24. The tips 18 are slidingly moved along the flange 12 of the end cap 8 radially of the shaft 4 and pressed against the inner surface of the core 2 under the effect of the tapered surfaces 16 of the slide 10, to thereby fix the core 2 to the shaft 4.

At least one of the shafts 4 is then rotated by the motor means 7. In the apparatus, at least one of the shafts 4 further includes key means 28 and pin means 30 for restraining the slide 10 from moving relatively to the shaft 4 in the rotational direction thereof to transmit a torque to the slide 10 from the shaft 4. The key means 28 comprises a key extending axially of the shaft 4 and fitted into axial grooves formed in the end cap 8 and the shaft 4. The pin means 30 comprises a plurality of pins angularly spaced from each other along the circumference of the end cap 8, mounted on the flange 12 and extending axially of the shaft 4. The pins 30 are inserted into holes 32 formed in the slide 10 to transmit a torque to the slide 10 from the shaft 4 through the keys 28, the end cap 8 and the flange 12. The slide 10 is therefore rotated integrally with the shaft 4, the keys 28, the end cap 8 and the pins 30.

In addition, a plurality of grooves 34 are formed in the circumferential outer surface of the slide 10 for restraining the tips 18 from moving relatively to the slide 10 in the rotational direction of the shaft 4. The tips 18 are received in the axial grooves 34 to transmit the torque to the tips 18 from the slide 10. The tapered surfaces 16 are formed on the bottoms of the axial grooves 34, the tips 18 being engaged with the tapered surfaces 16. The core 2 is therefore rotated integrally with the shaft 4, the slide 10 and the tips 18 to wind the web material.

Each of the tips 18 includes an urethane rubber layer 36 formed on the outer surface thereof and pressed against the inner surface of the core 2. Each of the tips 18 has a wedged section with a slope corresponding to the tapered surfaces 16 of the slide 10 so that the urethane rubber layer 36 extends axially of the shaft 4 and the core 2 when the tips 18 are engaged with the tapered surfaces 16. In addition, the urethane rubber layer 36 is curved along circular arcs centered at the shaft 4. Accordingly, all the urethane rubber layer 36 is pressed against the inner surface of the core 2 so that the core 2 is rotated without slippage between the tips 18 and the core 2.

In addition, each of the shafts 4 includes a ring spring 38 disposed around the tips 18 and the slide 10. The ring spring 38 is fitted into circumferential grooves 40 and 42 formed in the tips 18 and the slide 10 so that the tips 18 are resiliently urged radially of the shaft 4 and brought into contact with the tapered surfaces 16 of the slide 10 by the ring spring 38. The circumferential grooves 40 in the tips 18 are different in position axially of the shaft 4 from the circumferential grooves 42 in the slide 10 so that the tips 18 are resiliently urged axially of the shaft 4 and brought into contact with the flange 12 by the ring spring 38. In addition, a plurality of springs 44 are interposed between the slide 10 and the flange 12. The springs 44 are inserted at one end into holes 46 formed in the slide 10 and engaged at the other end with the flange 12 so that the slide 10 is resiliently urged axially of the shaft 4 and brought into contact with the piston 20.

After winding in the apparatus, the fluid pressure is discharged from the bore 22 in the cylinder 24 so that the slide 10 and the piston 20 are pushed axially of the shaft 4 by the springs 44 and moved back to the original positions. The tips 18 are pushed radially of the shaft 4 by the ring spring 38, disengaged from the inner surface of the core 2 and moved back to the original positions so that the core 2 are released from the tips 18. The arms 6 are then moved axially of the shafts 4 to retract the shafts 4 from the opposite ends of the core 2. The core 2 and the product thereon are taken out from the position between the shafts 4.

Accordingly, in the apparatus, the core 2 is fixed at opposite ends to the shafts 4 by the tips 18 pressed against the inner surface of the core 2. In each shaft 4, the tips 18 are pressed against the inner surface of the core 2 by the fluid pressure in the cylinder 24 and under the effect of the tapered surfaces 16 of the slide 10, the slide 10 being disposed coaxially to the shaft 4 and moved axially of the shaft 4. The core 2 is therefore accurately centered with respect to the shafts 4 by the slide 10 and the tips 18 when fixed at opposite ends to the shafts 4. The core 2 is then rotated without deflection. The web material is wound with a tension not fluctuated, resulting in high quality of product.

Figure 5:
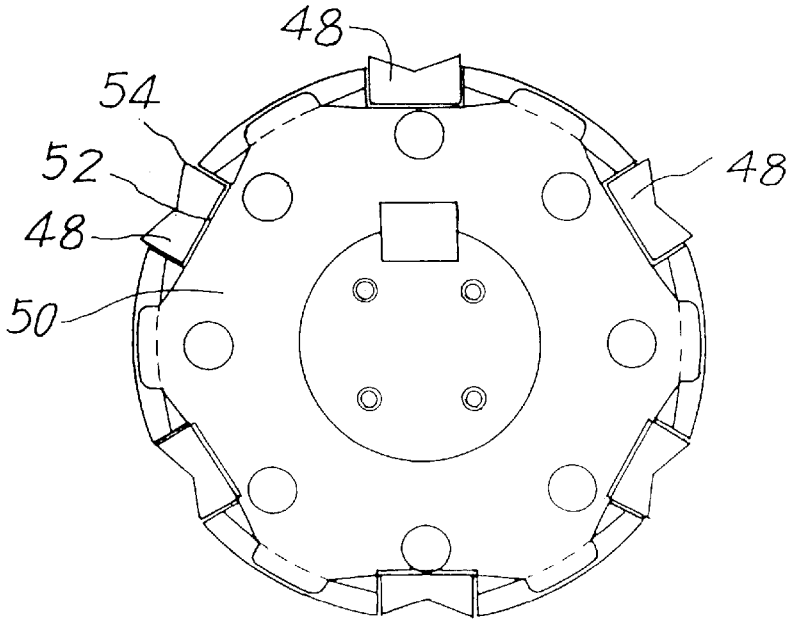
FIG. 5 is a cross sectional view of other embodiment of the invention.

In another embodiment shown in FIG. 5, not four but six tips 48 are equiangularly spaced from each other along the circumference of the slide 50 and engaged with the tapered surfaces 52 respectively. Any number of the tips may be angularly spaced from each other along the circumference of the slide and engaged with the tapered surfaces thereof.

The tips 48 may each include not the urethane rubber layer but a pair of ridges 54 formed at the opposite sides of the outer surface thereof and extending axially of the shaft. The ridges 54 bite into the inner surface of the core to thereby fix the core to the shaft when the tips 48 are pressed against the inner surface of the core. A single ridge may be formed at the center of the outer surface of the tip 48 to bite into the inner surface of the core.

Figure 6:
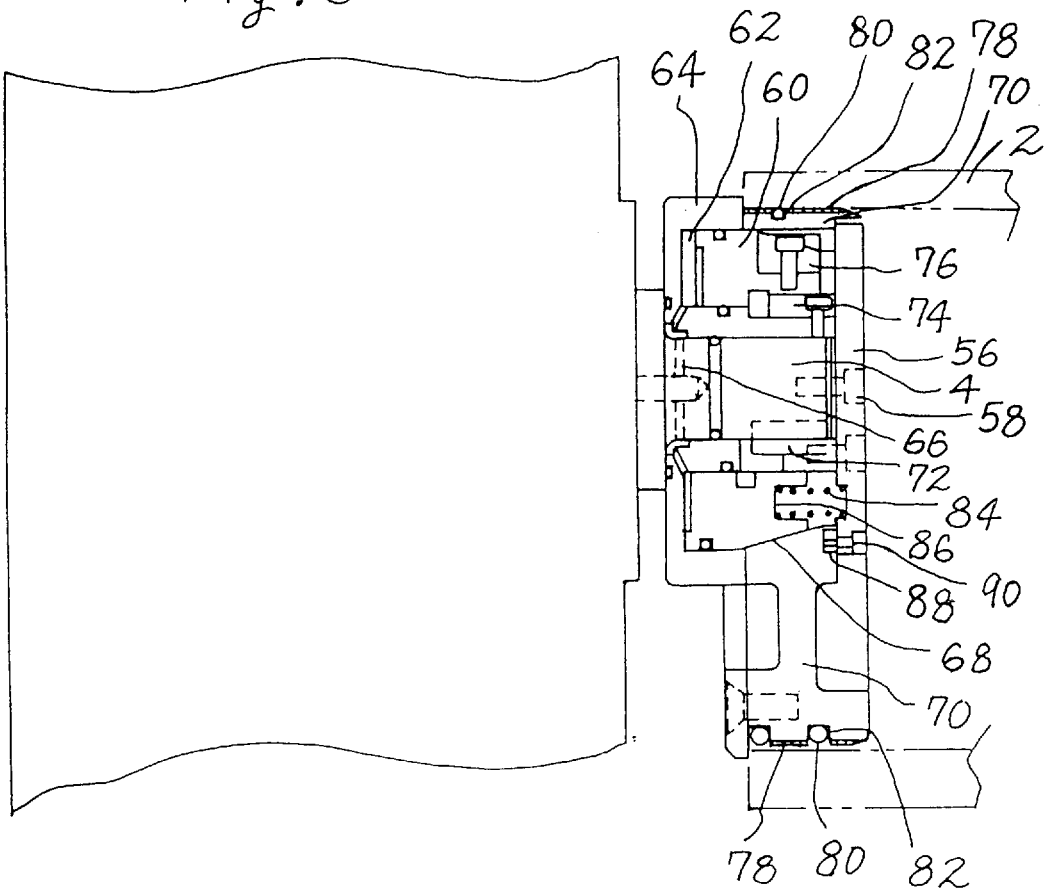
FIG. 6 is a longitudinal sectional view of another embodiment of the invention.

In another embodiment shown in FIG. 6, each of the shafts 4 includes an end plate 56 engaged with the end of the shaft 4. The end plate 56 is fixed to the end of the shaft 4 by bolts 58, the end plate 56 extending radially of the shaft 4. In addition, each of the shafts 4 includes an annular piston 60 disposed around and coaxially to the shaft 4. The piston 60 is inserted into an annular bore 62 formed in a cylinder 64 for movement axially of the shaft 4. The cylinder 64 is annular and coaxial to the shaft 4, and fitted onto the circumferential outer surface of the shaft 4. The end plate 56 is engaged with and pressed against the cylinder 64 axially of the shaft 4 to thereby fix the cylinder 64 to the shaft 4. The bore 62 is connected to a fluid source through flow paths 66 formed in the shaft 4 and the cylinder 64.

Figure 7:
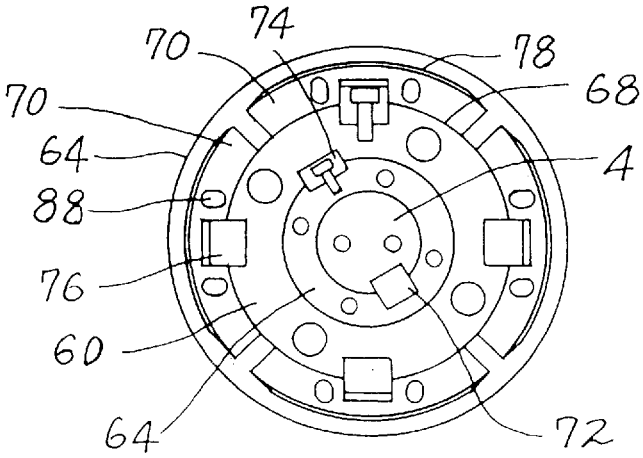
FIG. 7 is a cross sectional view of the apparatus in FIG. 6.

The piston 60 includes tapered surface means 68 formed on the circumferential outer surface thereof. The tapered surface means 68 comprises a tapered surface extending circumferentially of the piston 60 and inclined radially and axially of the shaft 4. A plurality of tips 70 are angularly spaced from each other along the circumference of the piston 60 and engaged with the tapered surface 68. In the embodiment, four tips 70 are equiangularly spaced form each other and curved along the circumference of the piston 60, as shown in FIG. 7. Each of the tips 70 has a width slightly less than one-fourth of the circumference of the piston 60 to surround the circumference of the piston 60 with small clearances between the tips 70. The end plate 56 is adapted to guide the tips 70 for movement radially of the shaft 4. The tips 70 are engaged with the end plate 56 for sliding movement.

In the apparatus, the arms are moved axially of the shafts 4 to insert the shafts 4 into the opposite ends of the core 2 which is disposed between the shafts 4, like the apparatus shown in FIG. 1. In each shaft 4, a fluid pressure is then fed into the bore 62 in the cylinder 64 through the flow paths 66 so that the piston 60 is moved and advanced in the bore 62 axially of the shaft 4 by the fluid pressure in the cylinder 64. The tips 70 are therefore slidingly moved along the end plate 56 radially of the shaft 4 and pressed against the inner surface of the core 2 under the effect of the tapered surface 68 of the piston 60, to thereby fix the core 2 to the shaft 4.

At least one of the shafts 4 is then rotated by the motor means. In the apparatus, at least one of the shafts 4 further includes key means 72 and 74 for restraining the piston 60 from moving relatively to the shaft 4 in the rotational direction thereof to transmit a torque to the piston 60 from the shaft 4. The key means 72 comprises a key extending axially of the shaft 4 and fitted into axial grooves formed in the cylinder 64 and the shaft 4 to transmit a torque to the cylinder 64 from the shaft 4. The key means 74 comprises a key extending axially of the shaft 4 and fitted into axial grooves formed in the piston 60 and the cylinder 64 to transmit the torque to the piston 60 from the cylinder 64. The piston 60 is therefore rotated integrally with the shaft 4, the cylinder 64 and the keys 72 and 74.

In addition, key means 76 is provided for restraining the tips 70 from moving relatively to the piston 60 in the rotational direction of the shaft 4 to transmit the torque to the tips 70 from the piston 60. The key means 76 comprises four keys disposed in the angular positions corresponding to the tips 70 and extending axially of the shaft 4. The keys 76 are fitted into axial grooves formed in the tips 70 and the piston 60 to transmit the torque to the tips 70 from the piston 60. The core 2 is therefore rotated integrally with the shaft 4, the piston 60 and the tips 70 to wind the web material.

Like the tips 18 in FIG. 1, each of the tips 70 includes an urethane rubber layer 78 formed on the outer surface thereof and pressed against the inner surface of the core 2. Each of the tips 70 has a wedged section with a slope corresponding to the incline 68 of the piston 60 so that the urethane rubber layer 78 extends axially of the shaft 4 and the core 2 when the tips 70 are engaged with the incline 68. The urethane rubber layer 78 is curved along the circular arcs centered at the shaft 4. Accordingly, all the urethane rubber layer 78 is pressed against the inner surface of the core 2 so that the core 2 is rotated without slippage between the tips 70 and the core 2.

In addition, each of the shafts 4 includes a ring spring 80 disposed around the tips 70. The ring spring 80 is fitted into circumferential grooves 82 formed in the tips 70 so that the tips 70 are resiliently urged radially and axially of the shaft 4 and brought into contact with the tapered surface 68 of the piston 60 and the end plate 56 by the ring spring 80. A plurality of springs 84 are interposed between the piston 60 and the end plate 56. The springs 84 are inserted at one end into holes 86 formed in the piston 60 and engaged at the other end with recesses formed in the end plate 56 so that the piston 60 is resiliently urged axially of the shaft 4 by the springs 84.

After winding in the apparatus, the fluid pressure is discharged from the bore 62 in the cylinder 64 so that the piston 60 is pushed axially of the shaft 4 by the springs 84 and moved back to the original position. The tips 70 are pushed radially of the shaft 4, disengaged from the inner surface of the core 2 and moved back to the original positions so that the core 2 is released from the tips 70. The arms are then moved axially of the shafts 4 to retract the shafts 4 from the opposite ends of the core 2. The core 2 and the product thereon are took out from the position between the shafts 4.

In the apparatus, the core 2 is accurately centered with respect to the shafts 4 by the piston 60 and the tips 70 when fixed at opposite ends to the shafts 4. The core 2 is then rotated without deflection. The web material is wound with a tension not fluctuated, resulting in high quality of product.

In addition, each of the tips 70 includes a radial groove 88 formed in the end surface thereof. Screws 90 are threadedly engaged with the end plate 56 and inserted into the radial grooves 88 in the tips 70 to prevent the tips 70 from moving radially of the shafts 4 to fall off.

The screws 90 can be removed from the end plate 56. The ring spring 84 can also be removed from the tips 70. The tips 70 can be then removed from the shaft 4 to exchange for other ones. Accordingly, when it is intended to use a core having a different inner diameter, the apparatus can fix it to the shafts 4 by utilizing tips having heights corresponding to the inner diameter of the core. In the upper half in FIG. 6, low tips 70 are shown to fix a core 2 having a small inner diameter. In the lower half in FIG. 6, high tips 70 are shown to fix a core 2 having a large diameter. The tips 70 can be angularly spaced along the circumference of the piston 60 and engaged with the tapered surface 68 thereof to surround the circumference of the piston 60 with small clearances between the tips 70, irrespective of the heights of the tips 70. The ring spring 80 can be therefore fitted into circumferential grooves 82 in the tips 70.

What is claimed is:

1. A core securing device in a web winding apparatus for winding a web material such as paper or plastic film about a hollow cylindrical core, said winding apparatus including a pair of shafts spaced from and opposed and aligned with each other axially thereof, said core being disposed between said shafts and secured at opposite ends to said shafts respectively, and motor means connected to at least one of said shafts to rotate the shaft, said securing device comprising:

a hollow annular slide disposed around and coaxially to each shaft for movement axially of the shaft, said slide having incline means formed on the outer periphery thereof and inclined to converge on the axis of said shaft;

a plurality of tips angularly spaced from each other along the circumference of said slide and engaged with said incline means;

means for guiding said tips for movement radially of said shaft;

cylinder means provided on each shaft for creating a fluid pressure, said cylinder means including a bore formed therein and positioned around the shaft to open toward said slide;

piston means fitted into said bore and engaged with said slide for forcing said slide axially of said shaft by the fluid pressure in said cylinder means and forcing said tips radially of said shaft under the effect of said tapered surface means, to thereby secure said core to said shaft by pressing said tips against the inner surface of said core;

means for restraining said slide of said at least one of said shafts from moving relatively to said shaft in the rotational direction thereof to transmit a torque to said slide from said shaft; and means for restraining said tips of said at least one of said shafts from moving relatively to said slide in the rotational direction of said shaft to transmit the torque to said tips from said slide.

2. A device as set forth in claim 1, wherein said shafts each comprises an end cap fitted onto and fixed to the end of said shaft, said slide being fitted onto the circumferential outer surface of said end cap for sliding movement axially of said shaft.

3. A device as set forth in claim 2, wherein said means for guiding said tips comprises a flange formed integrally with said end cap and extending radially of said shaft, said tips being engaged with said flange for sliding movement.

4. A device as set forth in claim 3, wherein said means for restraining said slide comprises a plurality of pins mounted on said flange and extending axially of said shaft, said pins being inserted into holes formed in said slide to transmit a torque to said slide from said shaft through said end cap and said flange.

5. A device as set forth in claim 4, wherein said means for restraining said tips comprises a plurality of axial grooves formed in the circumferential outer surface of said slide, said tips being received in said axial grooves to transmit the torque to said tips from said slide, said tapered surface means comprises a plurality of tapered surfaces formed on the bottoms of said axial grooves, said tips being engaged with said tapered surfaces.

6. A device as set forth in claim 5, wherein said cylinder means comprises a hollow annular cylinder fitted onto the circumferential outer surface of said shaft, said piston means comprising a hollow annular piston disposed around said shaft and inserted into an annular bore formed in said cylinder.

7. A device as set forth in claim 6, wherein said tips each includes an urethane rubber layer formed on the outer surface thereof and pressed against the inner surface of said core.

8. A device as set forth in claim 7, wherein said shafts each comprises a ring spring disposed around said tips and said slide, said ring spring being fitted into circumferential grooves formed in said tips and said slide so that said tips are resiliently urged radially and axially of said shaft and brought into contact with said tapered surfaces and said flange by said ring spring, a plurality of springs being interposed between said slide and said flange so that said slide is resiliently urged axially of said shaft and brought into contact with said piston by said springs.

9. A core securing device in a web winding apparatus for winding a web material such as paper or plastic film about a hollow cylindrical core, said winding apparatus including a pair of shafts spaced from and opposed and aligned with each other axially thereof, said core being disposed between said shafts and secured at opposite ends to said shafts respectively, and motor means connected to at least one of said shafts to rotate the shaft, said securing device comprising:

a hollow annular piston disposed around and coaxially to each shaft, said piston having tapered surface means formed on the outer periphery thereof and inclined to converge on the axis of said shaft;

a plurality of tips angularly spaced from each other along the circumference of said piston and engaged with said tapered surface means;

means for guiding said tips for movement radially of said shaft;

a cylinder provided on each shaft, said cylinder including an annular bore formed therein and positioned around the shaft, said piston being fitted into said bore to be forced axially of said shaft by the fluid pressure in said cylinder for forcing said tips radially of said shaft under the effect of said tapered surface means, to thereby secure said core to said shaft by pressing said tips against the inner surface of said core;

means for restraining said piston of said at least one of said shafts from moving relatively to said shaft in the rotational direction thereof to transmit a torque to said piston from said shaft; and means for restraining said tips of said at least one of said shafts from moving relatively to said piston in the rotational direction of said shaft to transmit the torque to said tips from said piston.

10. A device as set forth in claim 9, wherein said cylinder is hollow and annular and fitted onto the circumferential outer surface of said shaft.

11. A device as set forth in claim 10, wherein said means for guiding said tips comprises an end plate engaged with and fixed to the end of said shaft, and said end plate extending radially of said shaft, said tips being engaged with said end plate for sliding movement.

12. A device as set forth in claim 11, wherein said means for restraining said piston comprises key means fitted into axial grooves formed in said cylinder and said shaft to transmit a torque to said cylinder from said shaft, and key means fitted into axial grooves formed in said piston and said cylinder to transmit the torque to said piston from said cylinder.

13. A device as set forth in claim 12, wherein said tapered surface means comprises a tapered surface extending circumferentially of said piston, said means for restraining said tips comprising key means fitted into axial grooves formed in said tips and said piston to transmit the torque to said tips from said piston.

14. A device as set forth in claim 13, wherein said tips each includes an urethane rubber layer formed on the outer surface thereof and pressed against the inner surface of said core.

15. A device as set forth in claim 14, wherein said shafts each comprises a ring spring disposed around said tips, said ring spring being fitted into circumferential grooves formed in said tips so that said tips are resiliently urged radially and axially of said shaft and brought into contact with said tapered surface and said end plate by said ring spring, a plurality of springs being interposed between said piston and said end plate so that said piston is resiliently urged axially of said shaft by said springs.

* * * * *

UNITED STATES PATENT AND TRADEMARK OFFICE

CERTIFICATE OF CORRECTION

PATENT NO. : 5,863,011
APPLICATION NO. : 08/742089
DATED : January 26, 1999
INVENTOR(S) : Narita et al.

It is certified that error appears in the above-identified patent and that said Letters Patent is hereby corrected as shown below:

Title page,
Item [57], ABSTRACT,
Line 10, delete "tins" and insert -- tips --.

Column 8,
Lines 13 and 18, delete "incline means" and insert -- tapered surface means --.

Signed and Sealed this

Twenty-seventh Day of June, 2006

JON W. DUDAS
*Director of the United States Patent and Trademark Office*